United States Patent [19]

Vaterlaus

[11] Patent Number: 5,004,130

[45] Date of Patent: Apr. 2, 1991

[54] OUTLET AND FLOW CONTROL DEVICE FOR METALLURGICAL VESSELS AND PROCESS

[75] Inventor: Arthur Vaterlaus, Rüschlikon, Switzerland

[73] Assignee: Arva AG, Rüschlikon, Switzerland

[21] Appl. No.: 229,858

[22] PCT Filed: Nov. 27, 1987

[86] PCT No.: PCT/CH87/00161

§ 371 Date: Aug. 31, 1988

§ 102(e) Date: Aug. 31, 1988

[87] PCT Pub. No.: WO88/04209

PCT Pub. Date: Jun. 16, 1988

[30] Foreign Application Priority Data

Dec. 1, 1986 [CH] Switzerland ..... 4782/86
Sep. 30, 1987 [CH] Switzerland ..... 3805/87

[51] Int. Cl.[5] ..... B22D 41/10

[52] U.S. Cl. ..... 222/590; 164/437; 222/598; 222/602; 266/236; 266/265; 266/271

[58] Field of Search ..... 222/601, 602, 597, 591, 222/590, 598; 266/236, 271, 265; 164/437

[56] References Cited

U.S. PATENT DOCUMENTS 3,083,422 4/1963 Finkl ..... 164/61 X
3,214,804 11/1965 Saccomano ..... 222/602 X
3,643,680 2/1972 Hall et al. ..... 164/337 X
3,651,825 3/1972 Sury ..... 222/603 X
4,728,012 3/1988 Monks ..... 222/602 X

FOREIGN PATENT DOCUMENTS 1558285 5/1970 Fed. Rep. of Germany .
3414252 10/1985 Fed. Rep. of Germany ..... 222/602
2315347 1/1977 France .

*Primary Examiner*—Richard K. Seidel
*Assistant Examiner*—J. Reed Batten, Jr.
*Attorney, Agent, or Firm*—Frishauf, Holtz, Goodman & Woodward

[57] ABSTRACT

A stopper (6), secured to the lower end of a stopper rod, carries a plug (13) having a radial throttle aperture (14) above which a frustoconical shut-off surface (16) is located. The frustoconical surface fits against a valve seat surface 18 of an outlet tube (3) from a vessel, to form a first seal. A further seal is provided by an annular surface (19) of the plug (13) engaging in the outlet passage. The stopper (6) is rotatable so that the direction of flow of the molten metal from the vessel (1) and, passing through the stopper—when raised—can be influenced, if desired continuously during flow of the melt. This provides flow control and a safe shutoff of metal flow. The formation of vortices in the molten metal is largely prevented, thus avoiding the carrying along of slag.

20 Claims, 5 Drawing Sheets

OUTLET AND FLOW CONTROL DEVICE FOR METALLURGICAL VESSELS AND PROCESS

FIELD OF THE INVENTION

The invention relates to an outlet and flow control device for metallurgical vessels accommodating molten metals, the device comprising a casting outlet located at the bottom of the vessel and a stopper which cooperates with the casting outlet and is located at the lower end of a vertically mobile rod projecting into the interior of the vessel.

BACKGROUND:

The invention also relates to a casting process.

Numerous devices are already available for controlling the discharge and flow of molten metals from a vessel.

In the case of a very early system for casting steel or the like, use is made of a stopper mechanism in which the outlet aperture in the bottom of the vessel is adapted to be closed off by a stopper located in the interior of the vessel, the stopper being secured to the lower end of a rod. By means of a system of levers adapted to be actuated from the outside, the stopper may be raised for pouring and may be lowered again to close the outlet. The disadvantage of this system is that flow control and the shutoff safety is unsatisfactory for example as a result of the formation of deposits or wear upon the stopper.

It has also already been proposed to use rotating valves by means of which an eccentric inlet duct can be brought into communication with an outlet aperture by a rotating connection. This requires very accurate machining and grinding of 1 difficult spherical joint between the rotating and the stationary components. Furthermore, the molten metal tends to solidify in the inlet aperture.

Also known are sliding closures built onto the bottom of the vessel containing the molten metal, but the closure elements, which slide one upon the other under preload, are subject to considerable wear since movement of the adjustable parts must take place at the high temperatures of the molten metal. Another disadvantage is the high procurement and maintenance costs. Great accuracy in the machining of the slides, which are made of refractory material, is also required in order to achieve reliable sealing.

Another problem arising during the casting of molten metals is the need to prevent slag, and other non-metallic inclusions, from being carried along. Many attempts have been made to solve this problem. For example, it is known to use tundishes with partition-like displacement elements in order to promote separation of non-metallic inclusions in the molten metal. It has been found in practice, that the carrying along of non-metallic inclusions by suction in the discharge area cannot be prevented. Apart from this, building up the dams and weirs after each casting cycle is very costly and time-consuming.

It has also been proposed to keep the slag away from the outlet by injecting an inert gas, but this involves a relatively major technical effort and the results are questionable. It is also known to arrange, concentrically with the discharge duct, a sensor based upon electromagnetism. This makes it possible to evaluate the difference in measurements of molten metal and slag, so that, when slag is detected, the casting process is halted. It is particularly difficult to introduce such sensors in areas of wear in the outlet duct. Furthermore, a certain amount of slag has to pass through the duct before it can be detected.

There is also the requirement that the molten metal shall, as far as possible, not come into contact with air.

Another problem is that in the case of tundishes comprising one inlet and several outlets, the temperature of the molten metal at different outlets varies and this is undesirable.

Even if there is only one outlet, some of the molten metal flows directly from the inlet to the outlet and will therefore be at a temperature higher than that of metal circulating for some time in dead areas.

Separating non-metallic inclusions may also raise problems if the period of residence in the metallurgical vessel is too short, or if the melt is highly turbulent, since such inclusions require a certain amount of time to rise to the surface of the melt.

THE INVENTION

It is a purpose of the invention to provide an outlet and a flow control device, and a casting process, which is of simple and inexpensive design; which can be relied upon to prevent the molten metal from breaking through a seal; which permits constant, accurate control of the flow of molten metal; which largely prevents vortexing during casting; and which also prevents slag from being carried along as the metal is discharged.

Briefly, a stopper device comprises, in its closed position, an, at least, approximately cylindrical plug which contains, at its periphery, at least, one radial throttle aperture which merges into a longitudinal bore, open at the bottom of the plug. The stopper has an expanded head and a first seal that is adapted to be closed by lowering the stopper, being formed between the head and the edge of a casting pipe. Preferably the plug between its throttle aperture and the first seal located thereabove has, an annular part which forms, together with the adjacent part of the bore, a second seal. The stopper is opened by lifting the plug; flow control is effected by rotation of the plug to selectively orient the aperture in the plug with respect to the vessel containing the melt and if desired, to continuously rotate and reorient the plug during flow of the melt.

An outlet and flow control device of this kind, according to the invention, is comparatively simple to produce. Two consecutively acting seals provide good resistance to wear. The controllable and during casting, continuously variable flow characteristics also facilitates casting and ensures accurate metering of the flow of metal per unit of time during the casting process. There is also little vortexing.

The casting process according to the invention is characterized in that a predominantly horizontal direction of flow is imparted to the molten metal, at least in the area near the outlet and the rotational position of the, at least approximately, horizontal outlet aperture or apertures may be varied continuously while the metal is being poured.

The slag is prevented from being carried along by influencing and smoothing the flow in the metallurgical vessel, reoxidizing of the molten metal is prevented, and separation of non-metallic inclusions is promoted by smoothing the flow.

The enforced, largely horizontal direction flow of near the outlet from the metallurgical vessel produces a smooth flow with no vortexing and thus no premature carrying along of slag. Since the horizontal casting outlet can be rotated during the casting process, it is possible to adapt flow conditions to the shape of the relevant vessel, to different levels in the bath, to the melting temperature, and to other parameters, from case to case or continuously. As a result of the smooth inlet flow through the pouring distributor, there are no rebound waves of molten metal from the bottom and this avoids flushing of the floating layer of slag preventing reoxidizing. The smooth flow also facilitates and accelerates the ascent of non-metallic inclusions to the surface of the molten metal.

DRAWINGS

The figures illustrate examples of embodiment of the invention:

Figure 1:
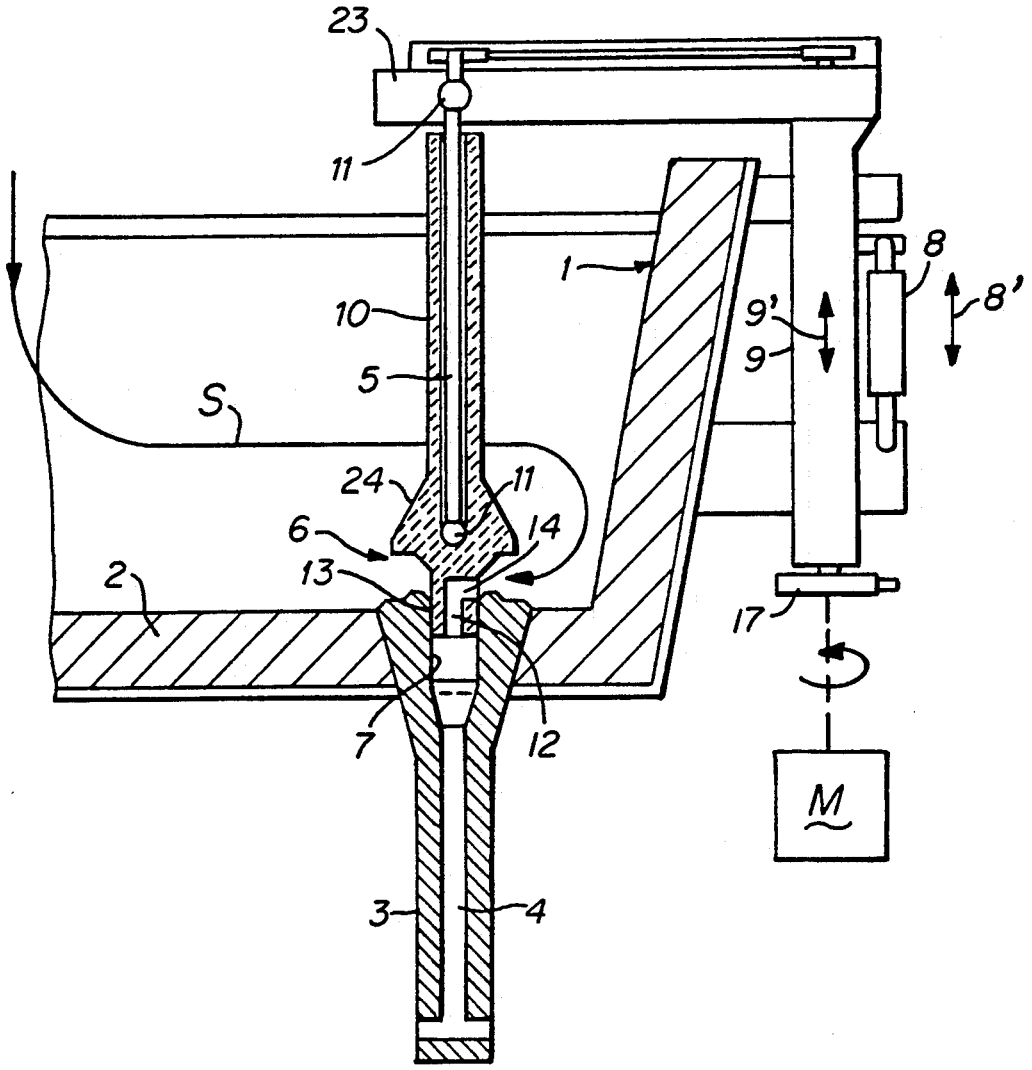
FIG. 1 is a cross-section through the device together with the melting vessel.

DETAILED DESTRIPTION:

According to FIG. 1, an outlet aperture, with an outlet pipe 3 open at the bottom, is located in bottom 2 of a vessel 1 which holds molten metal. Projecting into bore 7 of outlet pipe 3 is a stopper 6 made of a refractory material by means of which the flow of molten metal can be regulated.

An operating, or stopper rod 5 projects into a hollow neck or sleeve-like extension, or stem 10 of the stopper, the rod 5 permitting the stopper to be moved vertically and to be rotated about its axis. Movement is controlled by a drive mechanism 17 located externally of vessel 1. The vertical drive may consist of a mechanical, motor-driven spindle 8 or of a hydraulic or pneumatic lifting cylinder see arrow 8'. A horizontal arm 23 is connected, above the edge of the vessel to a vertical guide element 9 and movable as shown by arrow 9'. The connections between the upper end of stopper rod 5 and arm 23, and between the lower end of the stopper rod and bell-like head 24 of the stopper are by floating couplings namely in the form of ball joints 11. The stopper rod held in neck hollow sleeve 10 has radial play. A rotary drive 17, used to rotate stopper 6 about its vertical axis, is connected to a drive-motor M. This motor may be a servo- or stepping-motor i.e. a position controllable motor by means of which the different rotational positions of stopper 6 may be programmed and reproduced. The change in the rotational position of the stopper may also be effected by a pneumatic or hydraulic drive. Rotation is transferred between rod 5 and sleeve 10 by a key 27 (FIG. 2) on rod 5 engaging a groove or spline 29 in sleeve 10.

Stopper 6 comprises a cylindrical plug 13 engaging in bore 7 of outlet duct 4 and is provided with a horizontal, radial throttle aperture 14 which opens into a passage part 12 and merges into outlet duct 4. Since plug 13 is open radially only on one side, a predetermined flow direction is imparted to the emerging molten metal, as shown by line S in FIG. 1. In the area in front of the casting aperture, together with the bell-like stopper head 24, which is larger in diameter than plug 13, the most horizontal flow possible is sought in order to prevent vortexing of the molten metal and the sucking-in of slag from above. The direction of flow may also be varied, stepwise or continuously, during the casting process, by rotating the stopper about its vertical axis. Lowering the stopper reduces the flow cross-section of the throttle aperture, or shuts it off completely.

The stopper linkage and arm 23 can be locked or clamped on upper ball joint 11 of stopper rod 5 automatically by means of a clamping device to transfer rotational force and rotate sleeve 10, as well as tc transfer vertical forces. Initially, the stopper rod, which moves with play, and stopper 6 need not be accurately aligned. The neck 10, formed as sleeve or hollow stem (see FIG. 1) provides protection from the molten metal and the ball joints or couplings 11 provide alignment play. The control forces pass through the linkage 23, ball joints 11 and via key 27 and spline 29 directly into the head of the stopper when the upper ball joint 11 is clamped; yet the stopper 6 is protected from flexural forces arising from misalignment. The usual operations needed to align stopper 6 again outlet pipe 3 are eliminated and the stopper can be positioned automatically even in hot metallurgical vessels, since the ball joints 11 permit limited relative deflection in vertical and horizontal planes between the sleeve 10 and rod 5. This results in a reduction in vessel turn-around time and thus a reduction in maintenance time.

The design of a variant of stopper 6 in the closed and open position is described hereinafter in conjunction with FIGS. 2 and 3. The stopper comprises a cylindrical or slightly conical plug projecting into bore 7 of casting pipe 3. Located in plug 13—in contrast to the design according to FIG. 1—are several radial throttle apertures 14 distributed uniformly around the periphery of the plug. The upper and lower areas of these apertures are wedge-shaped, whereas the central areas have parallel vertical lateral walls 35. The longitudinal axes of the said throttle apertures extend vertically, i.e. in the direction of movement of the stopper. This provides more advantageous control characteristics as compared with circular throttle apertures. Throttle apertures 14 open into the central lower open longitudinal bore part 15 of plug 13. Above the apertures, plug 13 merges into a frustoconical expansion 16 which forms a frustoconical shut-off surface having a central angle of between 75° and 105°, preferably 90°. Together with a frustoconical counterbore 18 of the same angle at the upper edge of bore 7, this forms a first annular seal 20. Located between the uppermost edge of throttle apertures 14 and frustoconical shut-off surface 16, on plug 13, is a closed cylindrical annular part 19 of width V (FIG. 3). When stopper 6 is closed, i.e. lowered, this annular part 19 provides, together with adjacent cylindrical bore 7, of matching diameter, a second seal 21. The lowermost part of plug 13 is also in the form of an annular part 22 closed at the casing. Thus plug 13 remains guided in bore 7 even when throttle apertures 14 are fully open.

Figure 2:
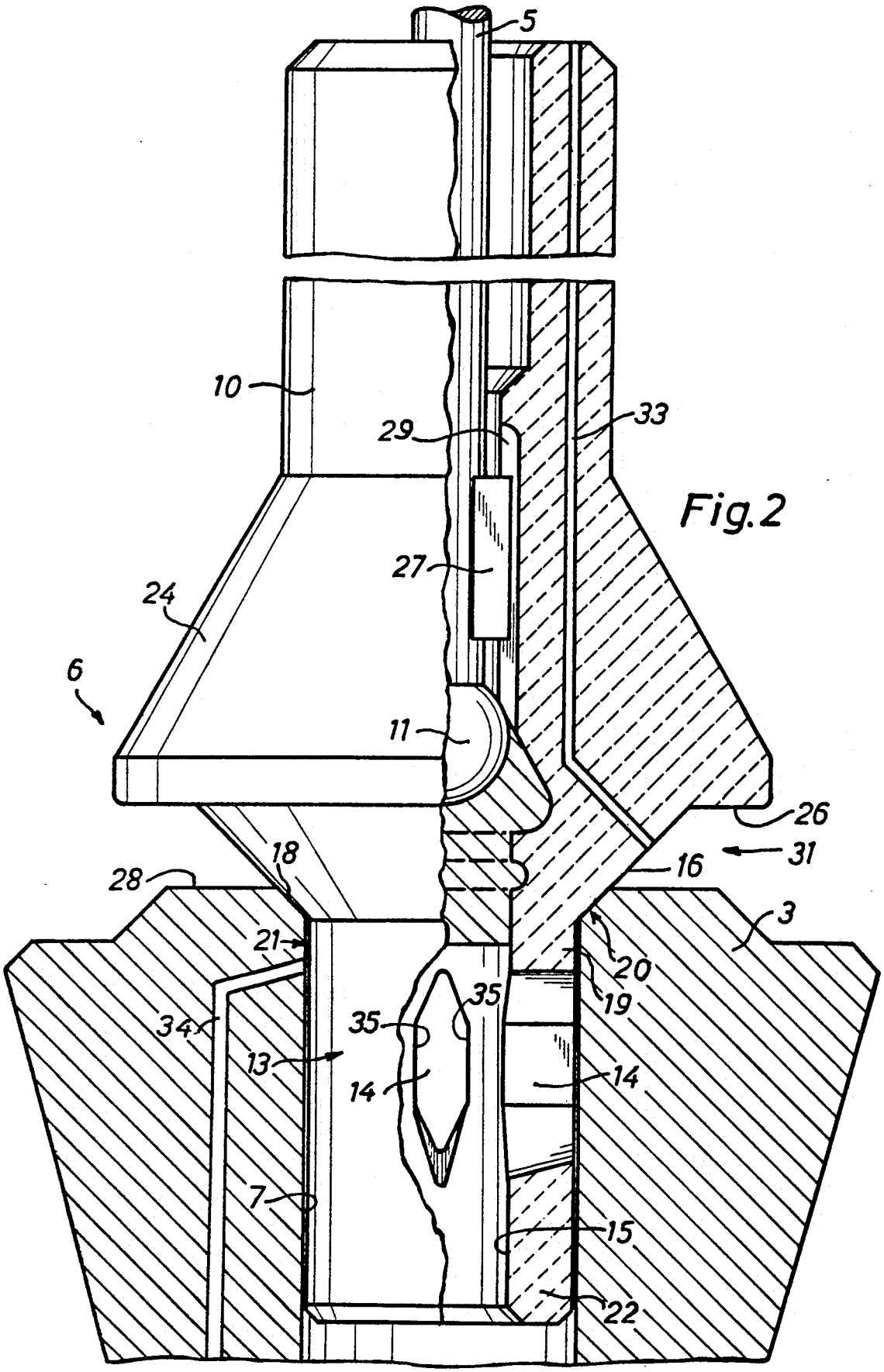
FIG. 2 is a partial section through the stopper in its closed position projecting into the casting aperture.
Figure 3:
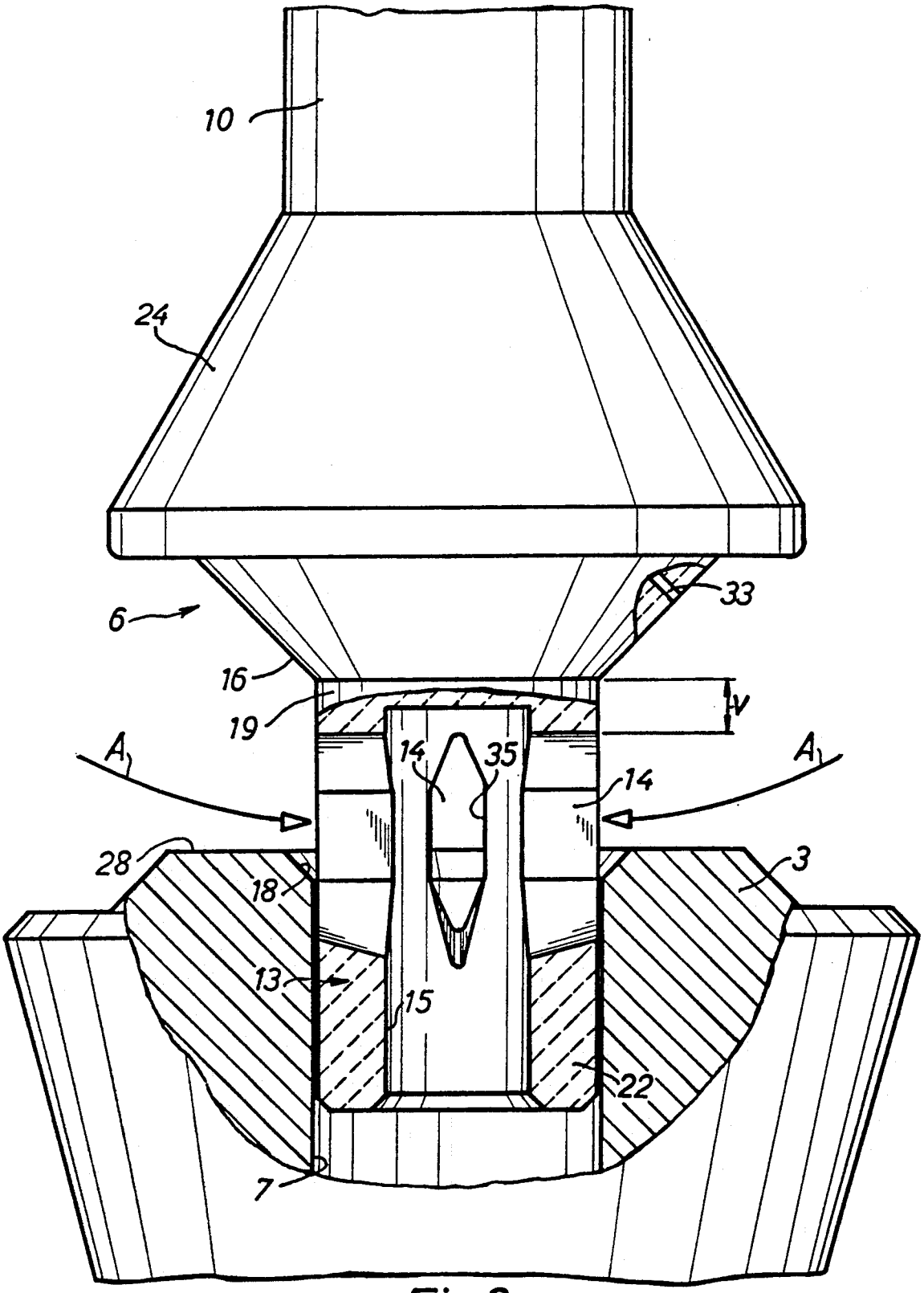
FIG. 3 is a section through the stopper in its open position.

Since when stopper 6 is in the closed position according to FIG. 2, throttle apertures 14 are not in contact with the molten metal, there is no danger of the molten metal freezing in this area. Above frustoconical expansion 16, stopper head 24 is expanded into the form of a bell. This prevents, or greatly reduces, a discharge vortex in the interior of vessel 1, thus preventing slag inclusions from being carried along. When stopper 6 is closed, the approximately horizontal lower edge 26 of expanded stopper head 24 is relatively far away from horizontal surface 28 of casting pipe 3, so that a relatively wide annular space 31 is provided for the molten metal in front of first seal 20. This relatively large mass of molten metal surrounding bore 7 reduces its cooling and counteracts any blockage. In addition to this, the design of stopper head 24 imparts an approximately horizontal flow to the incoming molten metal, as indicated in FIG. 3 by arrows A. This prevents a vertical vortex from forming in the molten metal, even if the level thereof in the vessel is low. Slag is thus not drawn prematurely into the discharge. Furthermore, this annular space 30 may be flushed with argon or the like which may be fed to stopper 6 by thin supply lines 33 which may also be used to produce a control signal. As soon as the outlet end emerges from the molten metal, there is a drop in the pressure of gas in the supply line. This makes it possible to shut off the casting flow before any slag is included therein.

Since two seals, acting consecutively, are provided, this reduces the risk of a breakthrough of molten metal, even if surface 16 or counterbore 18 of first seal 20 is damaged by wear.

Second seal 21 may also be kept free of incoming molten metal by injecting gas through passages 34.

Figure 4:
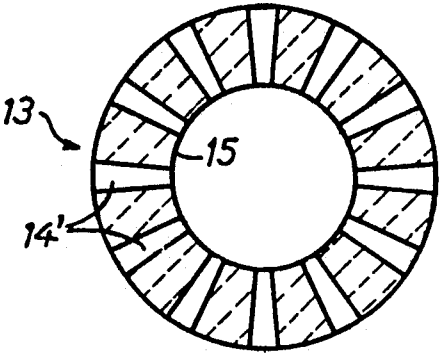
FIG. 4 is a cross-section through a variant in the direction of arrows IV—IV in FIG. 5.
Figure 5:
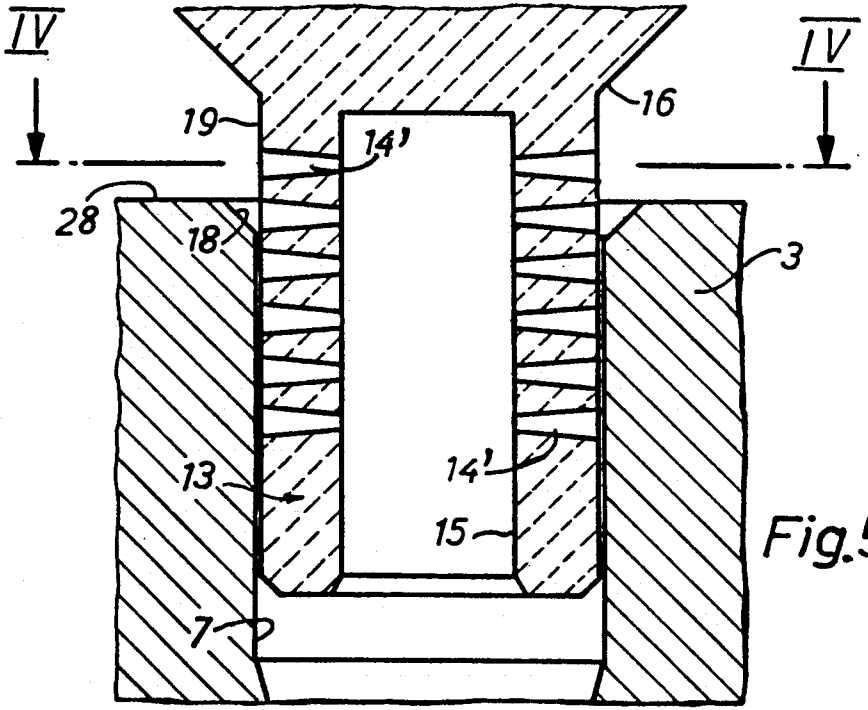
FIG. 5 is a longitudinal section through the variant according to FIG. 4 with a plurality of throttle apertures.

FIGS. 4 and 5 illustrate a variant in which the throttle apertures in stopper 6 consist of a plurality of relatively small radial holes 14' around the periphery, arranged one above the other in axial rows. This provides filtration of the molten metal. If upper holes 14' are blocked off, stopper 6 is raised so that new, still open holes, are exposed for flow and filtration.

Figure 6:
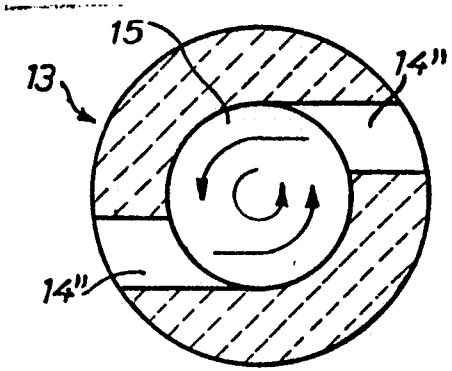
FIG. 6 is a cross-section through another variant with staggered throttle apertures producing a twist in the emerging molten metal.

In the variant, according to FIG. 6, two throttle apertures 14" are arranged on opposite sides of plug 13 and are staggered in relation to the centreline so that they run approximately tangentially to longitudinal discharge opening 15. This imparts to the emerging molten metal a twist as shown by the arrows. This prevents the formation of deposits upon the outlet, since lighter inclusions remain in the centre of the vortex.

Figure 7:
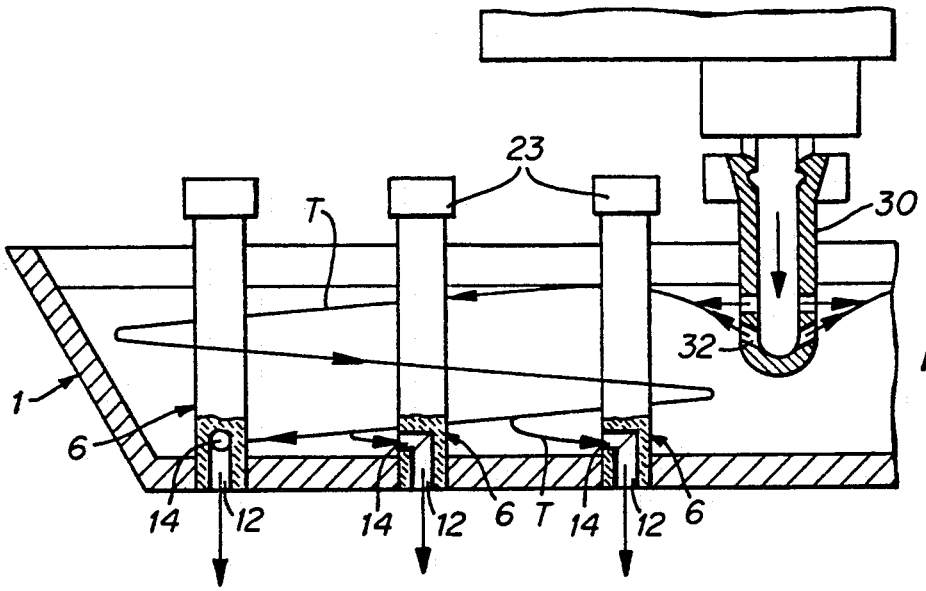
FIG. 7 is a longitudinal section through a vessel in the form of an intermediate receptacle with a pouring distributor and a plurality of stoppers.
Figure 8:
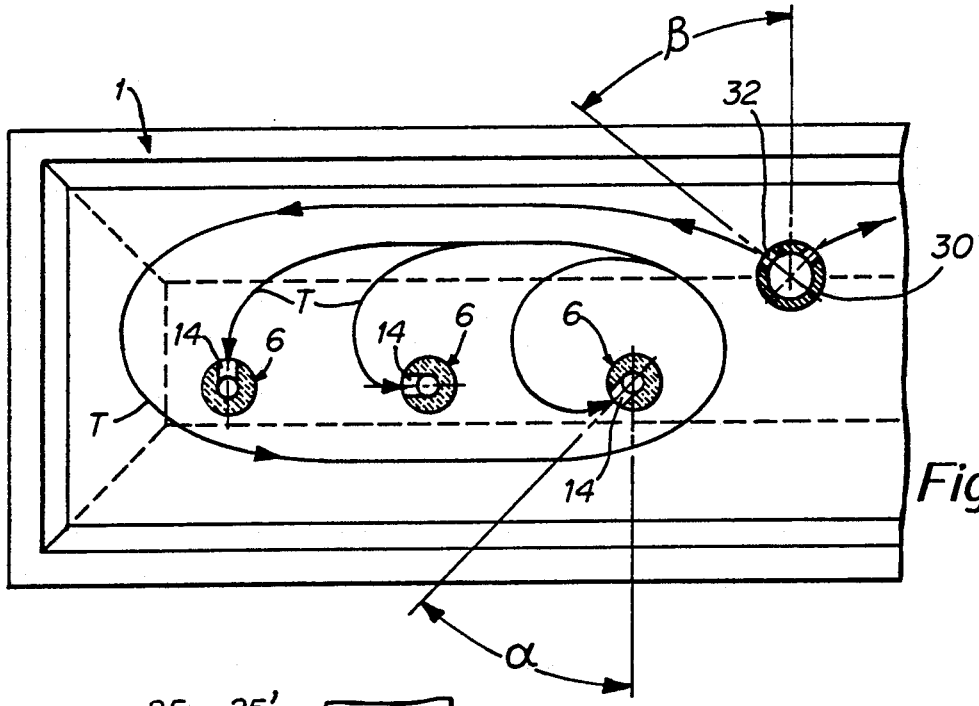
FIG. 8 is a plan view of the intermediate receptacle according to FIG. 7 showing the different rotational positions of the casting apertures in the plugs in cross-section.
Figure 9:
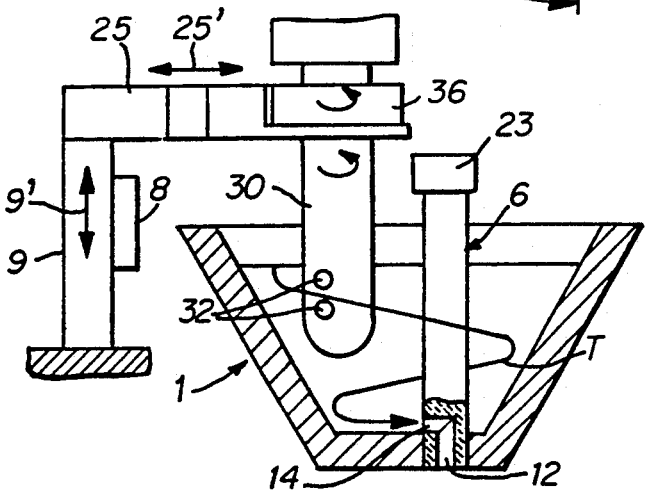
FIG. 9 is a cross-section through the intermediate receptacle according to FIG. 7 with a sharper downward cross-sectional taper.

FIGS. 7, 8 and 9 illustrate a variant in which vessel 1 is in the form of an intermediate receptacle with a pouring distributor 30 and several stoppers adapted to rotate independently of each other. In the case of such distributing vessels or intermediate receptacles with a plurality of casting outlets, the problem is that the difference in the length of the paths travelled produces different temperatures in the molten metal, and this is undesirable. Immersing the pouring distributor 30 in the molten metal, and outlet aperture 32, below the level of the bath, which is directed, rotatable by a drive element 36 and predominantly horizontal, causes the molten metal to emerge approximately horizontally and produces a smooth flow approximately in the direction of path T in FIGS. 7, 8 and 9. This flow is dependent upon inflow angle $\beta$ (FIG. 8) of pouring distributor 30 and upon inflow angle $\alpha$ of stopper 6. The flow vectors of the outlet and inlet produce a torque in the molten metal, as a result of which individual elements of the melt descend, from the hot layer near the surface, spirally to the colder layer near the bottom. The purpose of the spiral flow is to achieve paths of roughly the same length for all throttle apertures 14 in order to avoid temperature differences. Flow paths T, shown diagrammatically in FIGS. 7, 8 and 9 cannot actually be maintained in practice, but since the part flows in the metal are thoroughly mixed, temperature distribution is satisfactory and dead areas are avoided. FIGS. 7 and 8 show only one half of such an intermediate receptacle.

The period of residence of the molten metal in vessel 1 may be influenced by the choice of angles $\alpha$ and $\beta$. The smooth flow provides an opportunity for non-metallic inclusions to ascend rapidly, by their own buoyancy, to the surface and into the layer of slag floating thereupon, so that they are not carried along by turbulence into the outlet duct. This also applies to slag. The substantially horizontal flow obtaining in the casting area of metallurgical vessel 1 eliminates vortices and premature carrying along of slag, and this improves the quality of the end product, reduces scrap, and increases production.

FIG. 9 shows a cross-section through the intermediate receptacle from which it may be seen that the walls slope sharply, thus producing a preferred flow path. FIG. 9 also shows by arrows 9' and 25' vertical and horizontal adjustment effected by suitable positioning elements or motors, along guides 9 and 25.

Individual stoppers 6 according to FIGS. 7 to 9 correspond to those according to FIG. 1 and may thus be raised, lowered and rotated as explained in connection with FIG. 1. Individual or joint control may be effected by a predetermined programme as a function of casting parameters such as temperature, throughput and analysis. Data-processing units may also be used for this purpose. Pouring distributor 30 may also be included in such a programmed control, i.e. angle $\beta$ and/or the height thereof may be varied. The throttle cross-sections in stopper 6 may also be adjusted individually by raising or lowering.

I claim:

1. An outlet valve structure to control flow of a metallic melt, adapted for installation in the bottom (2) of a vessel (1) containing the melt, said valve structure comprising an essentially vertically positioned outlet pipe (3) having a vertical bore (7) therethrough;

a first sealing part (18) formed at an upper end portion of the vertical bore (7);

stopper means (6) comprising a plug (13), said plug (13) being formed with a second sealing part (16) dimensioned and shaped to fit against said first sealing part (18), said first and second sealing parts forming a first seal (20) for the melt;

a central longitudinal discharge opening (15) formed in said plug (13), said opening (15) having a lower open end discharging into said vertical bore (7);

at least one radially directed aperture (14) communicating with said discharge opening (15);

an operating rod (5) extending in vertical direction within, and outside of said vessel (1);

a hollow sleeve or stem (10) extending from said stopper means (6) and surrounding said operating rod, with radial play or clearance;

coupling link means (11) permitting limited relative deflection in a vertical and a horizontal plane located between the stopper means (6) and at least one end of the rod (5) to permit limited movement of the plug (13) with respect to the link means (11) and self alignment of said first seal (20); and an arm means (23) coupled to the upper end of the rod (5), said arm means being positioned outside of the upper portion of the vessel, said arm means selectively transferring vertical reciprocating and rotational movement to said rod to control, respectively and selectively, vertical reciprocation of the plug (13) between the lowered position on said first seal (20) and a raised open position permitting communication between the interior of said melt containing vessel (1) and said radially directed aperture (14) and hence said discharge opening (15) and selective orientation of the radial position of said aperture with respect to said vessel.

2. The structure of claim 1 wherein said first seal comprises a frustoconical shut-off surface (16) formed on the plug (13) and a matching conical surface (18) formed at the upper end of the bore(7).

3. The structure of claim 1, wherein said link means (11) comprises at least one ball joint located at one of the ends of said operating rod (5), said at least one ball joint coupling the operating rod (5) with at least one of: said stopper means (6) and said arm means (23).

4. The structure of claim 1, further including a second seal (21), said second seal comprising an annular cylindrical part (19) having a closed outer surface, and extending from said plug (13) into said vertical bore (7) and defining, between an upermost portion of said radially directed aperture (14) and said first seal (20) a cylindrical plug second seal (21);

said first seal (20) opening first upon raising of said plug by said operating rod (5) to expose said radially directed aperture (14) to the interior of the vessel and hence permit melt to flow therethrough and through said longitudinal opening (15) and second seal opening subsequently to opening of said first seal.

5. The structure of claim 1, wherein said plug (13) is formed with a single, essentially horizontally directed aperture (14).

6. The structure of claim 1, wherein said at least one aperture comprises a plurality of substantially horizontally extending apertures (14') radially distributed around the periphery thereof.

7. The structure of claim 1, wherein said at least one aperture comprises a plurality of apertures (14') staggered axially along the length of the plug and communicating with said longitudinal discharge opening.

8. The structure of claim 1, wherein said at least one aperture (14") extends tangentially from the outside of said plug (13) to said longitudinal discharge opening (15), terminating tangentially therein.

9. The structure of claim 1, wherein said at least one aperture (14) in cross-section, is formed with two essentially vertically extending side surfaces (18), and at least one end surface which is wedge, or roof-shaped, whereby said opening will be essentially, in cross-section, diamond shaped with essentially vertical sides (35).

10. The structure of claim 1, wherein said stopper means (6) is formed with an approximately bell or mushroom shaped lateral extension above the second sealing part (16).

11. The structure of claim 4, further including at least one gas passage (34) formed in the outlet pipe (3) and terminating in the vicinity of the second seal (21).

12. The structure of claim 1, further including drive means (M; 17) coupled to said arm means (23) for transferring rotary movement to said stopper means (6).

13. The structure of claim 1, wherein said vessel (1) comprises an intermediate receptacle;

a melt pouring distributor (30) located in said intermediate receptacle, said melt pouring distributor being formed with a plurality of essentially horizontally directed outlet apertures (32);

and drive means (8, 25', 26) are provided for, selectively, controlling at least one of: vertical position; horizontal position; rotary position;

of said pouring distributor (30) within the intermediate receptacle.

14. The structure of claim 1, wherein said stopper means (6) is formed with at least one through-passage terminating in the vicinity of said second sealing part for injection of gas or powder therethrough.

15. An outlet valve structure for installation in the bottom (2) of a melt containing vessel (1) comprising an essentially vertical outlet pipe (3) having a vertical bore (7) therethrough;

a first sealing part (18) formed at the upper end of the vertical bore (7);

stopper means (6) comprising a plug (13), a second sealing part (16) arranged on said plug, dimensioned and shaped to fit against said first sealing part (18) for forming a first seal (20) for molten metal;

said plug (13) being formed with an essential longitudinal discharge opening (15), said opening having a lower end discharging into said vertical bore (7);

at least one essentially radially directed aperture (14) communicating with said discharge opening;

said plug (13) further comprising a cylindrical annular part (19) having a closed outer surface, and located between said at least one aperture (14) and said second sealing part (16), said cylindrical annular part (19) having an axial portion of predetermined dimension (V) which fits within the vertical bore (7) of said outlet pipe (3) to form therewith a second seal (21);

an operating rod (5) extending in a vertical direction through said vessel and towards the outside thereof, said vertical rod being coupled to said stopper means (6);

a hollow sleeve or stem extending from said stopper means (6) and surrounding said rod, with radial play or clearance;

and a loose coupling means (11) permitting limited relative deflection in a vertical and horizontal plane between said rod (5) and said stopper means (6) coupling said stopper means and said rod, said rod controlling at least vertical reciprocation of the plug (13) between a lowered, closed position and a raised, open position, so that, upon movement between said open and closed positions, the first and second seals will consecutively effect sealing between the interior of said vessel and the outlet pipe.

16. The structure of claim 15, wherein said coupling means comprises a ball joint (11), the loose coupling protecting said plug (13) against flexure forces.

17. A process for selectively withdrawing, or inhibiting withdrawal of molten metal, forming a melt, from a vessel, wherein the vessel includes an outlet pipe having a vertical downwardly directed bore through which said melt can flow through gravity, and a first sealing part formed at an upper end of the vertical bore;

and wherein stopper means are provided, comprising a plug, the plug having a second sealing part arranged thereon, dimensioned and shaped to fit against said first sealing part to form a first seal for the molten metal;

said plug being formed with a central longitudinal discharge opening having a lower open end discharging into said vertical bore, and an essentially radially directed aperture means connecting said discharge opening with the interior of the vessel, said process comprising the steps of imparting to the molten metal a predominantely horizontal direction of flow in the area near said outlet pipe, and varying the angular orientation of said flow with respect to said vessel by rotating the essentially radially directed aperture means within said plug, during flow of the melt through said aperture means, said opening, and said vertical bore.

18. The process of claim 17, including the step of introducing the molten metal into the vessel in an essentially horizontal direction but spaced vertically from said aperture means.

19. The process of claim 18, including the step or steps of varying continuously as a function of at least one predetermined command value, or a predetermined program at least one of: the vertical distance between the inflow of the melt and said aperture; the angle ($\beta$) of inflow with respect to the vessel; the angle ($\alpha$) of the outlet aperture means with respect to the vessel.

20. The process of claim 17, including the step of controlling the quantity per unit time of outflow of melt from said vessel through said aperture means and said discharge opening into said bore of said outlet pipe.

* * * * *